US007100796B1

(12) United States Patent
Orr et al.

(10) Patent No.: US 7,100,796 B1
(45) Date of Patent: Sep. 5, 2006

(54) APPARATUS FOR DISPENSING VIALS

(75) Inventors: Stacy D. Orr, Shawnee, KS (US); Timothy A. Giebler, Olathe, KS (US)

(73) Assignee: ScriptPro LLC, Mission, KS (US)

( * ) Notice: Subject to any disclaimer, the term of this patent is extended or adjusted under 35 U.S.C. 154(b) by 373 days.

(21) Appl. No.: 10/791,411

(22) Filed: Mar. 2, 2004

Related U.S. Application Data

(63) Continuation of application No. 10/716,831, filed on Nov. 19, 2003, now abandoned.
(60) Provisional application No. 60/493,917, filed on Aug. 8, 2003.

(51) Int. Cl.
*B65H 3/00* (2006.01)

(52) U.S. Cl. ..... 221/191; 221/312 R; 193/32; 193/44; 141/174; 141/369

(58) Field of Classification Search ..... 221/191, 221/193, 194, 312 R, 96; 193/32, 44; 141/174, 141/369, 370, 375; 198/406, 534
See application file for complete search history.

(56) References Cited

U.S. PATENT DOCUMENTS

| | | | | |
|---|---|---|---|---|
| 341,045 | A | | 11/1886 | Igel et al. |
| 1,128,561 | A | | 2/1915 | Webendorfer |
| 2,088,038 | A | | 7/1937 | Scott et al. |
| 2,137,501 | A | | 11/1938 | Myers |
| 2,178,000 | A | | 10/1939 | Siehrs |
| 2,348,927 | A | | 5/1944 | Runsvold et al. |
| 2,472,921 | A | * | 6/1949 | Quimper ..... 141/174 |
| 2,690,856 | A | | 10/1954 | Trondle |
| 2,781,947 | A | | 2/1957 | Webster et al. |
| 2,929,532 | A | | 3/1960 | Tonelli |
| 2,994,420 | A | * | 8/1961 | Tobias ..... 193/32 |
| 3,045,864 | A | | 7/1962 | Hurst et al. |
| 3,069,654 | A | | 12/1962 | Hough |
| 3,166,177 | A | | 1/1965 | Laverty |
| 3,193,196 | A | | 7/1965 | Merrill et al. |
| 3,206,062 | A | | 9/1965 | Rappaport |
| 3,215,310 | A | | 11/1965 | Hurst et al. |

(Continued)

FOREIGN PATENT DOCUMENTS

| | | |
|---|---|---|
| AU | 99676775 | 5/1997 |
| DE | 4235047 | 4/1994 |
| EP | 282785 A | 9/1986 |

(Continued)

OTHER PUBLICATIONS

Guerra, Lawrence E.; U.S. Appl. No. 10/896,477, Filed Jul. 22, 2004, Fork Based Transport Storage System for Pharmaceutical Unit.
Coughlin, Michael E.; U.S. Appl. No. 09/457,286, Filed: Dec. 8, 1999, Automatic Dispensing System for Unit Medicament Packages.
Knutsen, Bernhard P.; U.S. Appl. No. 10/869,595; Filed: Jun. 16, 2004; RFID Tag and Method of User Verification.
Fred Levit, Daniel Garside; Computer–Assisted Prescription Writing; Dec. 30, 1976.

(Continued)

*Primary Examiner*—David H. Bollinger
(74) *Attorney, Agent, or Firm*—Hovey Wiiliams LLP

(57) ABSTRACT

An apparatus (100) for guiding the movement of a flanged vial (10) during an automated process to prevent the flange (50) from disrupting the movement of the vial (10) during the process. The apparatus (100) includes a receptacle (120) with a narrowing peripheral wall (130) adapted to receive the vial (10) during a vertical drop and direct the movement of the vial (10) toward a slide (160). A weighted flap (170) contacts the vial (10) as the vial (10) moves along the slide (160), slowing the descent of the vial (10), holding the vial (10) against the slide (160), and pivoting to accommodate the flange (50). A platform (190) catches the vial (10).

5 Claims, 9 Drawing Sheets

U.S. PATENT DOCUMENTS 3,277,998 A 10/1966 Medoff
3,368,713 A 2/1968 Hurst et al.
3,400,857 A 9/1968 Schubert
3,603,327 A 9/1971 Buchholz et al.
3,677,437 A 7/1972 Haigler
3,692,211 A 9/1972 Flubacker
3,719,288 A 3/1973 Schmitt et al.
3,746,211 A 7/1973 Burgess, Jr.
3,782,590 A 1/1974 Apfel
3,823,844 A 7/1974 Linkemer et al.
3,837,139 A 9/1974 Roseberg
3,871,156 A 3/1975 Koenig et al.
3,885,702 A 5/1975 Joslin et al.
3,917,045 A 11/1975 Williams et al.
3,921,196 A 11/1975 Patterson
3,985,264 A 10/1976 Shaw et al.
3,997,063 A 12/1976 Adams et al.
4,013,192 A 3/1977 Pillon
4,018,358 A 4/1977 Johnson et al.
4,181,162 A * 1/1980 Newman et al. ..... 141/105
4,247,019 A 1/1981 Lerner
4,264,396 A 4/1981 Steward
4,284,301 A 8/1981 Geiger et al.
4,386,860 A 6/1983 Price et al.
4,468,277 A 8/1984 Kontz
4,476,381 A 10/1984 Rubin
4,546,901 A 10/1985 Buttarazzi
4,615,350 A 10/1986 Boudville
4,660,824 A 4/1987 Hermkens et al.
4,714,515 A 12/1987 Hoffmann
4,753,473 A 6/1988 Arnett
4,787,803 A 11/1988 van Elten et al.
4,803,487 A 2/1989 Willard et al.
4,810,230 A 3/1989 Shirasawa
4,811,764 A 3/1989 McLaughlin
4,835,372 A 5/1989 Gombrich et al.
4,851,072 A 7/1989 Kontz
4,857,716 A 8/1989 Gombrich et al.
4,868,409 A 9/1989 Tanaka et al.
4,869,394 A 9/1989 Hurst
4,872,803 A 10/1989 Asakawa
4,902,263 A 2/1990 Ito et al.
4,918,604 A 4/1990 Baum
4,954,817 A 9/1990 Levine
4,958,280 A 9/1990 Pauly et al.
5,007,085 A 4/1991 Greanias et al.
5,033,785 A 7/1991 Woolley, Jr.
5,082,268 A 1/1992 Santoro
5,194,857 A 3/1993 Gomez
5,208,762 A 5/1993 Charhut et al.
5,323,677 A 6/1994 Knutson
5,332,275 A 7/1994 Conway et al.
5,335,664 A 8/1994 Nagashima
5,337,919 A 8/1994 Spaulding et al.
5,348,061 A 9/1994 Riley et al.
5,401,059 A 3/1995 Ferrario
5,453,759 A 9/1995 Seebach
5,463,839 A 11/1995 Stange et al.
5,481,265 A 1/1996 Russell
5,493,805 A 2/1996 Penuela et al.
5,512,879 A 4/1996 Stokes
5,562,232 A 10/1996 Pearson
5,597,995 A 1/1997 Williams et al.
5,621,384 A 4/1997 Crimmins et al.
5,629,981 A 5/1997 Nerlikar
5,671,592 A 9/1997 Yuyama et al.
5,682,032 A 10/1997 Philipp
5,700,998 A 12/1997 Palti
5,706,026 A 1/1998 Kent et al.
5,713,485 A 2/1998 Liff et al.
5,713,487 A 2/1998 Coughlin
5,718,525 A 2/1998 Bruhnke et al.
5,762,235 A 6/1998 Coughlin
5,771,657 A 6/1998 Lasher et al.
5,781,511 A 7/1998 Yasukawa et al.
5,797,515 A 8/1998 Liff et al.
5,798,020 A 8/1998 Coughlin et al.
5,812,410 A 9/1998 Lion et al.
5,832,296 A 11/1998 Wang et al.
5,845,264 A 12/1998 Nellhaus
5,860,563 A 1/1999 Guerra et al.
5,873,488 A 2/1999 Guerra
5,883,370 A 3/1999 Walker et al.
5,884,806 A 3/1999 Boyer et al.
5,897,024 A 4/1999 Coughlin et al.
5,903,225 A 5/1999 Schmitt et al.
5,907,493 A 5/1999 Boyer et al.
5,959,530 A 9/1999 Lupien, Jr. et al.
5,963,453 A 10/1999 East
6,006,946 A 12/1999 Williams et al.
D418,494 S 1/2000 Robb
6,036,017 A 3/2000 Bayliss, IV
6,036,812 A 3/2000 Williams et al.
6,039,251 A 3/2000 Holowko et al.
6,070,140 A 5/2000 Tran
6,075,189 A 6/2000 Robb
6,085,938 A 7/2000 Coughlin
6,119,737 A 9/2000 Yuyama et al.
6,155,485 A 12/2000 Coughlin et al.
6,161,721 A 12/2000 Kudera et al.
6,206,590 B1 3/2001 Thomas et al.
D440,570 S 4/2001 Schneider
6,225,988 B1 5/2001 Robb
6,249,277 B1 6/2001 Varveris
6,310,542 B1 10/2001 Gehlot
6,318,630 B1 11/2001 Coughlin et al.
6,320,570 B1 11/2001 Robb
6,343,711 B1 2/2002 Coughlin
6,346,886 B1 2/2002 De La Huerga
D458,933 S 6/2002 Schneider
6,421,584 B1 7/2002 Norberg et al.
6,477,442 B1 11/2002 Valerino, Sr.
6,478,185 B1 11/2002 Kodama et al.
6,526,158 B1 2/2003 Goldberg
6,533,480 B1 3/2003 Schneider
6,564,104 B1 5/2003 Nelson et al.
6,574,580 B1 6/2003 Hamilton
6,575,596 B1 6/2003 Butt
6,578,734 B1 6/2003 Coughlin
6,587,090 B1 7/2003 Jarra
6,592,005 B1 7/2003 Coughlin et al.
6,600,418 B1 7/2003 Francis et al.
6,624,739 B1 9/2003 Stobbe
6,692,211 B1 2/2004 Yuyama et al.
6,695,207 B1 2/2004 Norris, Jr.
6,703,918 B1 3/2004 Kita
6,724,690 B1 4/2004 Endo et al.
6,774,796 B1 8/2004 Smith
2003/0142588 A1 7/2003 Kawatahara

FOREIGN PATENT DOCUMENTS

EP 0471530 12/1991
EP 0827733 8/1997
EP 0924676 10/1998
FR 1449591 9/1966
GP 2109137 5/1983
JP 52-37096 * 3/1977
JP 53145260 12/1978
JP 0043743 3/1984
JP 3031965 2/1991
JP 3240602 10/1991

| | | | |
|---|---|---|---|
| JP | 4174061 | | 6/1992 |
| JP | 6127635 | | 5/1993 |
| JP | 6315521 | | 11/1994 |
| JP | 7187165 | | 7/1995 |
| JP | 8007058 | | 1/1996 |
| JP | 8115376 | | 5/1996 |
| JP | 9034964 | | 2/1997 |
| JP | 9202301 | | 8/1997 |
| JP | 9231342 | | 9/1997 |
| JP | 09259344 | A | 10/1997 |
| JP | 11296727 | A | 10/1997 |
| JP | 10059336 | | 3/1998 |
| SD | SU918086 | | 8/1982 |
| WO | 9422580 | | 10/1994 |
| WO | 9529455 | | 11/1995 |
| WO | 9809598 | | 3/1998 |

OTHER PUBLICATIONS

National Institutes of Health; Prescription–Writing with a PC: Jun. 10, 2003.

Packaging Week Interpak; Integrated Cartoning and Labeling System; Jul. 1996.

Roerlg, CS; Assembly Automation; Automatic Pharmaceutical Inspection; 1993.

Alton Rosemary; Assembly Automation; Verification of Automated Pack Assembly: 1993.

Chain Store Age Executive: Longs Drug Stores' Systems Prescription; Dec. 1996.

Ukens, Carol; Drug Topics; Rx Description of Product Label Aids Accuracy.

McHugh, James A.; Phillips, Alexander J.; Computers in Healthcare: Managed–Care Pharmacy: An Integrated MIS Approach.

JICST; Development of a Printing System of Drug Envelope Labels with Personal Computer and Experience of its Usage.

Journal of Public Policy & Marketing: Comprehension Testing for OTC Drug Labels; Goals, Methods, Target Population, and Testing Environment.

Kaisher, Michael J.; Proceedings of the Human Factors and Ergonomics Society; Enhancing the Perceived Readability of Pharmaceutical Container Labels and Warnings: the Use of Alternative Designs and Pictorials.

Fluid Phase Equilbria; Pharmaceutical Container Labels: Enhancing Preference Perceptions with Alternative Designs and Pictorials.

Department of Clinical Pharmacy; A Survey of Prescription Label Preferences Among Community Pharmacy Patrons.

American Journal of Hospital Pharmacy; Effect of Call–In Prescription Refill System on Workload in an Outpatient Pharmacy.

Department of Mathematical Statistics and Operation Research; Retail Pharmacy Activities and Their Automation by Bar Code Recorder, Tablet Counter and Remote Computer.

Bohsel Pharmacy Co. Ltd.; Computerized Prescription Checking System.

Business Forms, Labels & Systems; Label/Tag.

Converting Magazine; A Prescription for Supplying the Pharmaceutical Industry.

Ursula Jones; How to Get More from your Label.

American Society of Consultant Pharmacist; White Paper on Automation in Pharmacy.

* cited by examiner

APPARATUS FOR DISPENSING VIALS

RELATED APPLICATION

The present application is a continuation application and claims priority benefit, with regard to all common subject matter, of earlier-filed U.S. nonprovisional patent application titled "APPARATUS FOR DISPENSING VIALS," Ser. No. 10/716,831, filed Nov. 19, 2003, now abandoned, and of earlier-filed U.S. provisional patent application titled "APPARATUS FOR DISPENSING VIALS," Ser. No. 60/493,917, filed Aug. 8, 2003. The identified earlier-filed application is hereby incorporated by reference into the present application.

BACKGROUND OF THE INVENTION

1. Field of the Invention

The present invention relates to an apparatus for dispensing vials. More particularly, the present invention relates to an apparatus for guiding the movement of a flanged vial during an automated process to prevent the flange from disrupting movement of the vial.

2. Description of Prior Art

Automated prescription dispensing- machines, such as the SP200 robotic prescription dispensing system manufactured and sold by ScriptPro LLC of Mission, Kans., have been developed to more accurately and efficiently dispense prescriptions. Such machines often include a vial dispenser which stores and automatically dispenses empty vials which are then filled with medicaments, labeled, and dispensed to a pharmacist or other authorized person and then given to patients.

Vial dispensers typically include a narrowing chute which is used to guide and place the vials. Such chutes typically include a large opening adapted to receive vials and a small opening adapted to allow the vials to leave the chute, wherein the chutes gradually narrow from the large opening to the small opening. The small opening typically is about the same diameter as the body of the vials so that each vial is precisely placed as it falls through the small opening. Thus, the chute funnels the vials to a particular point, which may be a point on a conveyor belt or a platform intended to retain the vials until a machine removes them. It will be appreciated that it is critical to precisely control both the location and the position of the vials upon leaving the chute. Errors introduced in the placement of a vial on a platform, for example, may result in improper orientation of a vial in a gripping jaw, which could cause a collision or premature release of the vial.

Such chutes work well with vials and other articles that are cylindrical in shape, symmetric and do not have substantial irregularities. However, many vials are intentionally manufactured with irregularities, such as cap release tabs, locking lugs or flanges and are therefore asymmetric. For example, newer vials now often include cap release tabs which may be used to add cognitive control requirements to opening the vials. Unfortunately, cap release tabs introduce difficulties into the automation process because vials with the tabs are not symmetrical and the tabs are susceptible to snagging on other tabs and the automated equipment. Such difficulties often preclude the use of conventional vial dispensers.

Attempts have been made to modify prior art vial dispensers to accommodate vials with tabs and other asymmetrical features. For example, to allow the tabs of a vial to leave the chute, the bottom opening thereof has been made significantly larger than the diameter of the body of the vial. However, this increases the risk of imprecise placement of the vial. One or more of the tabs may also snag on the chute near the bottom opening, causing undesirable rotation and/or congestion. Furthermore, the tabs cause the center of gravity of the vial to shift near the end of the vial, which may render the vial even more susceptible to undesirable rotation during drops.

Due to the above mentioned and other problems and disadvantages in the art, a need exists for an improved apparatus for dispensing vials of irregular shape.

SUMMARY OF THE INVENTION

The above described and other problems and disadvantages of the prior art are addressed by the present invention with an apparatus adapted to collect and dispense a vial with a cap release tab or other irregularity. The apparatus comprises a receptacle with a wall that forms a first opening and a second opening; a slide with a top end, a bottom end, an inner surface, and an outer surface; a flap with a hinge, a secured end, a pivot end, and an inner surface; a side wall; and a platform. An exemplary vial useful with the apparatus includes a mouth, a base, a body, and a flange. The flange may include cap release tabs, may partially or completely encircle the vial, and may be located near the mouth thereof.

The receptacle is adapted to catch the vial after a vertical drop and direct the movement of the vial toward the slide. The receptacle includes a peripheral wall with a first segment, a second segment, a third segment, and a fourth segment and forms a first opening and a second opening. The first opening preferably opens upward and the second opening preferably opens downward. Furthermore, the first opening is preferably larger than the second opening so that the peripheral wall is more narrow near the second opening than near the first opening.

The first opening is large enough to catch the vial as it falls through a vertical drop path. The size of the first opening may depend on the type of vial used as well as the height and location from which the vial is dropped. The second opening is adapted to allow the vial to leave the receptacle. The second opening is large enough to give passage to the flange, yet sufficiently restrictive to guide the descent of the vial to the slide.

The slide is adapted to catch the vial after it leaves the receptacle and guide its descent toward the platform. The slide attaches to the second segment of the wall and to the platform, and extends below the second opening. The slide is preferably substantially parallel with the second segment of the wall to eliminate any ridges that may snag the flange of the vial.

The flap moderates the descent of the vial along the slide and includes a hinge, a secured end, and a pivot end. The hinge pivotally secures the secured end of the flap to the first segment of the wall near the second opening so that the flap partially impedes the path of the vial as it moves down the slide. The secured end of the flap is connected to the hinge, allowing the pivot end to pivot about the secured end. The pivot end is sufficiently heavy to allow the flap to moderate the descent of the vial along the slide by slowing the vial in its descent and holding it against the slide.

The side wall prevents the vial from deviating laterally from a preferred path of descent and preferably substantially encloses a space between the flap and the slide. The platform is adapted to attach to the bottom end of the slide, to catch the vial as it moves down the slide, and to retain the vial.

In use, the vial is dropped into the receptacle as part of an automated manufacturing process, a prescription dispensing process, or other automated process. Upon entering the receptacle through the first opening, the vial contacts the peripheral wall, which guides the vial toward the second opening. The base of the vial passes through the second opening of the receptacle, makes contact with the slide, and begins to move down the slide. As the base of the vial moves along the slide the vial is forced into a position parallel with the slide. Thus, as the vial passes through the second opening it moves down the slide in a position parallel to the slide, preventing the flange from snagging the wall or the hinge of the flap.

As the vial moves down the slide, the base of the vial encounters the flap. The pivot end of the flap pivots away from the vial in response to pressure exerted on the flap from the vial, allowing the vial to pass the flap as the vial moves down the slide. The flap rests against the vial during the vial's descent along the slide, slowing the descent of the vial and preventing bouncing or other erratic movements of the vial. The flap accommodates passage of the flange by pivoting away from the flange. Thus the flap is adapted to moderate the descent of an article while accommodating irregularities in the shape of the article. The vial continues to move along the slide until the vial has cleared the flap and engages the platform. The platform catches the vial and supports it until a gripping mechanism or other machine removes the vial from the platform.

These and other important features of the present invention are more fully described in the section titled DETAILED DESCRIPTION OF PREFERRED EMBODIMENTS, below.

BRIEF DESCRIPTION OF THE DRAWINGS

Preferred embodiments of the present invention are described in detail below with reference to the attached drawing figures, wherein.

DETAILED DESCRIPTION OF PREFERRED EMBODIMENTS

Figure 1:
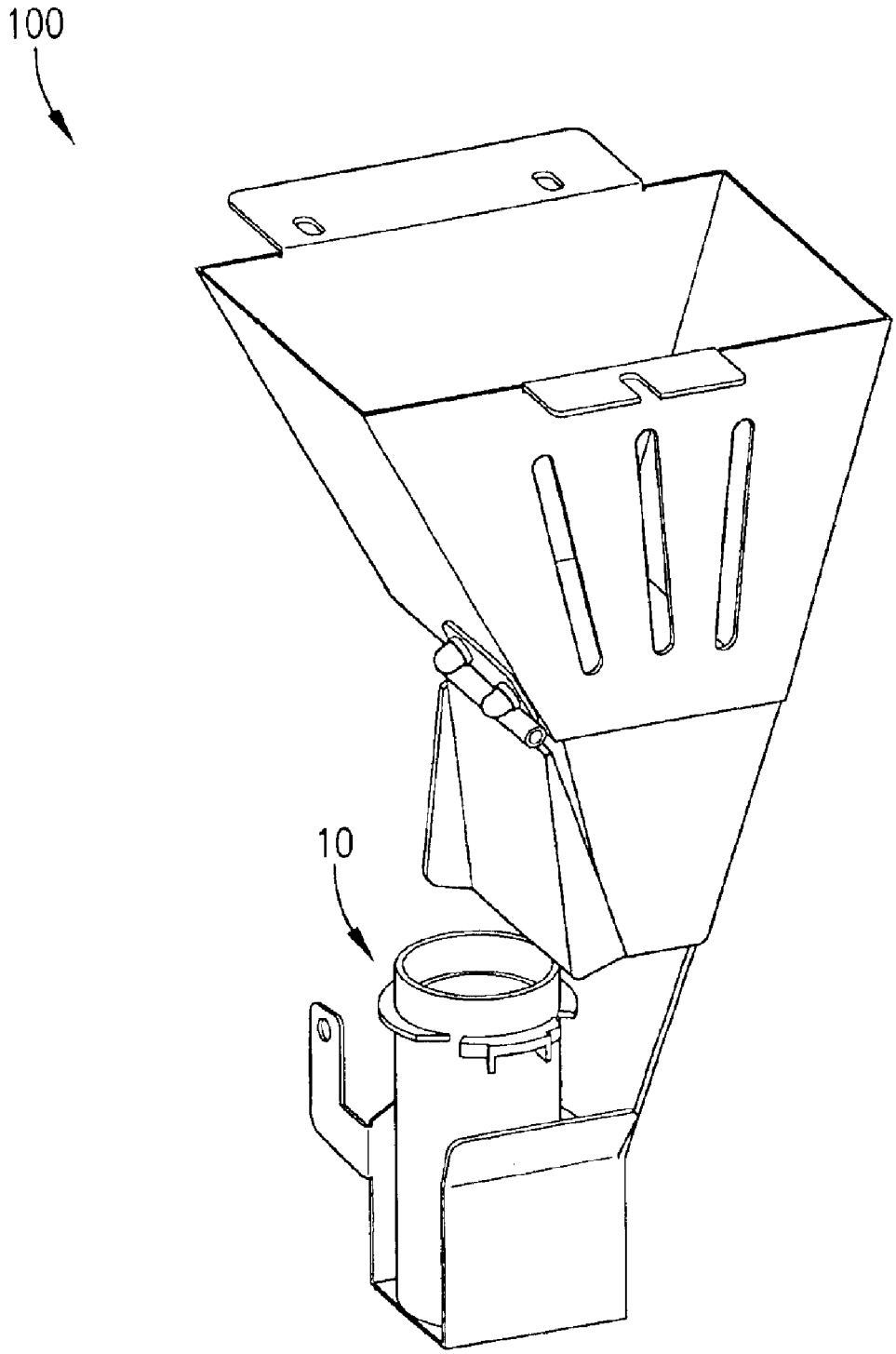
FIG. 1 is a perspective view of an apparatus for dispensing vials constructed in accordance with a preferred embodiment of the present invention.

Referring to FIG. 1, an apparatus 100 for collecting and dispensing a vial 10 is shown constructed in accordance with a preferred embodiment of the present invention. The apparatus 100 is adapted to collect and dispense the vial 10 after a vertical drop that is part of an automated process. For example, the apparatus 100 may be used as a vial dispenser in an automatic prescription dispensing machine such as the SP200 referenced above or may be used as a part of a vial manufacturing process.

Figure 2:
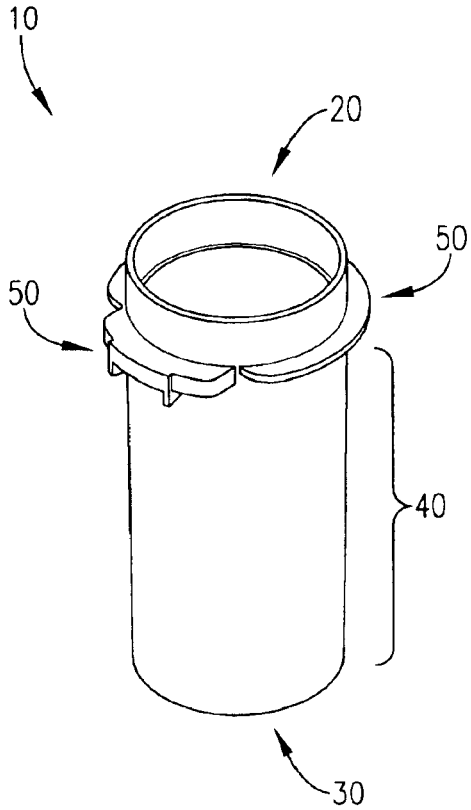
FIG. 2 is a perspective view of a vial which may be used with the apparatus of FIG. 1.

FIG. 2 more clearly illustrates the vial 10 used with the apparatus 100 of FIG. 1. The vial 10 includes a mouth 20, a base 30, a body 40, and a flange 50. The body 40 of the vial 10 is cylindrical in shape and substantially uniform in diameter, with the mouth 20 open to receive contents and the base 30 sealed to retain the contents. The flange 50 partially or completely encircles the vial 10 and may be located near the mouth 20. The flange 50 may include, for example, cap release tabs as described above. The flange 50 may be any protrusion, however, and may also include a flared rim, a spout, machine threads, or a handle. Furthermore, while the apparatus 100 has been described as being useful with the vial 10, the apparatus 100 may be useful with other articles of varying shapes, sizes and weights which contain similar flanges, protrusions, or other irregularities that may disrupt an automated process.

Figure 3:
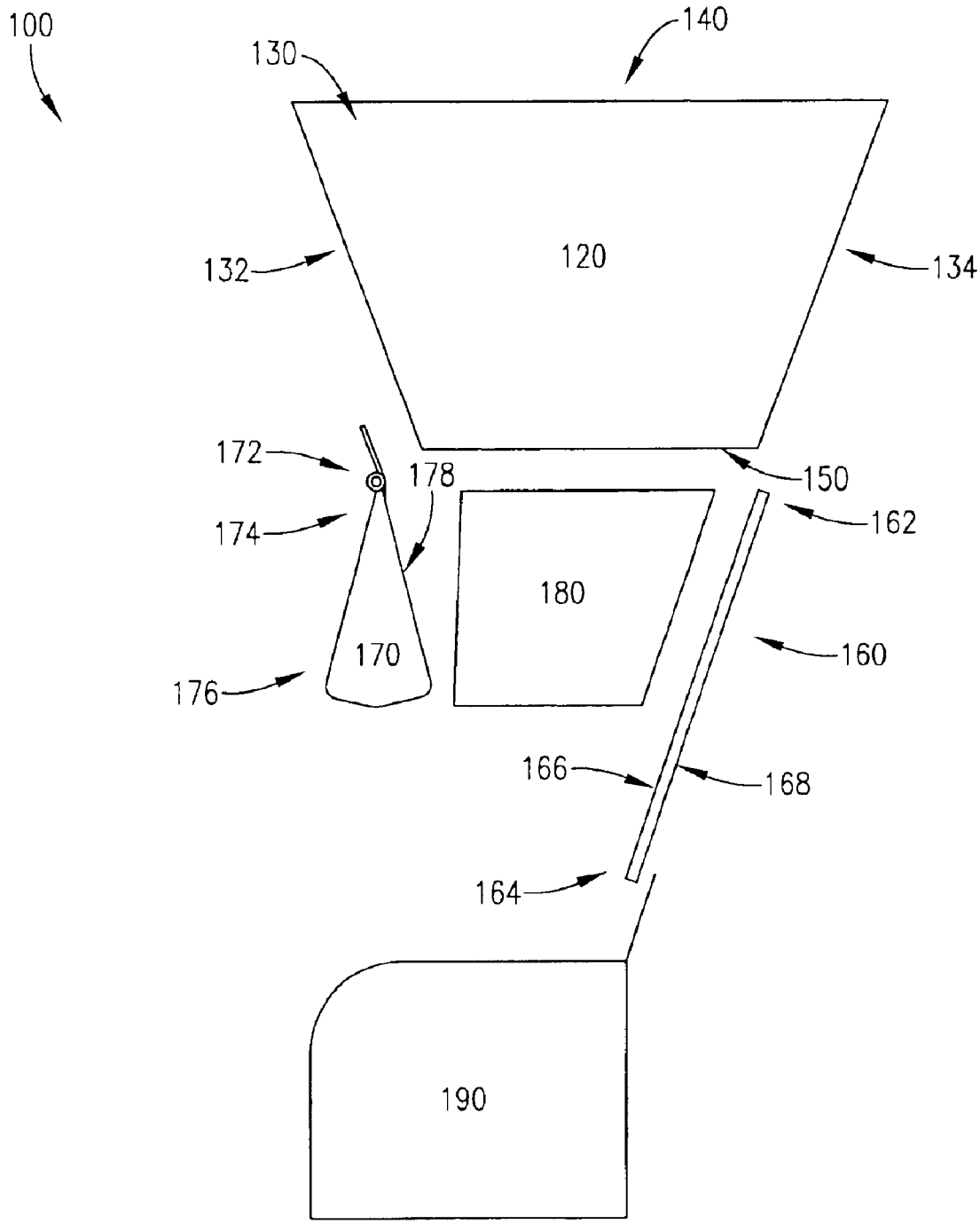
FIG. 3 is an exploded schematic of components of the apparatus of FIG. 1.

Referring to FIG. 3, the apparatus 100 comprises a receptacle 120 with a wall 130 that forms a first opening 140 and a second opening 150; a slide 160 with a top end 162, a bottom end 164, an inner surface 166, and an outer surface 168; a flap 170 with a hinge 172, a secured end 174, a pivot end 176, and an inner surface 178; a side wall 180; and a platform 190.

Figure 4:
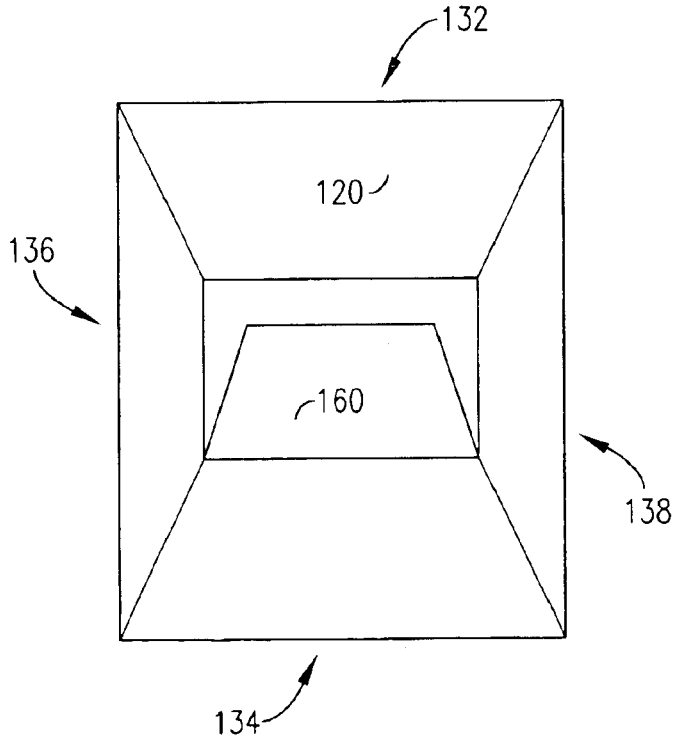
FIG. 4 is a top view of a receptacle and a slide of the apparatus of FIG. 1.

Referring also to FIG. 4, the receptacle 120 is adapted to catch an article, such as the vial 10, after a vertical drop and direct the movement of the article toward the slide 160. The receptacle 120 includes a peripheral wall 130 with a first segment 132, a second segment 134, a third segment 136, and a fourth segment 138. The wall 130 forms a first opening 140 and a second opening 150. The first opening 140 preferably opens upward and the second opening 150 preferably opens downward. Furthermore, the first opening 140 is preferably larger than the second opening 150 so that the peripheral wall 130 gradually narrows from the first opening 140 to the second opening 150, as illustrated. Such a narrowing configuration enables the receptacle 120 to funnel the vial 10 toward the slide 160.

The receptacle 120 may be built or positioned to direct the movement of the vial 10 substantially downward, along an inclined path, or along a curved path. It may be necessary to direct the vial 10 along a curved or extended path, for example, in an environment that is highly populated with machinery or other obstacles wherein the path between the first opening 140 and the second opening 150 is long and/or obstructed. It may be necessary in such a situation to drastically extend the length of wall 130 to further separate the first opening 140 and the second opening 150, transforming, in effect, the receptacle 120 into a tunnel which directs the movement of the vial 10 along an extended and/or curved path.

The first segment 132 and the second segment 134 of the wall 130 are preferably less inclined than the third segment 136 and the fourth segment 138, as illustrated in FIG. 4, causing an article falling through the receptacle 120 to tend to slide along the first segment 132 or the second segment 134. While shown at an incline, the third segment 136 and the fourth segment 138 may be completely or substantially vertical. An inner surface of the wall 130 is preferably smooth to allow the vial 10 to slide through the receptacle 120 substantially unimpeded, but may also be coarse to slow the descent of the vial 10. There may also be one or more hatches or doors located on any segment of the wall 130, giving a user access to the inside of the receptacle 120 to perform maintenance or to retrieve a vial 10 that has become lodged. Such a door would be especially useful in situations where access to the inside of the receptacle 120 is difficult or restricted, such as where the receptacle 120 is large and/or the distance between the first opening 140 and the second opening 150 is significant.

The wall 130 is preferably sufficiently durable to withstand the repeated impacts of falling articles, and may be constructed, for example, of steel, aluminum, or plastic. If the vial 10 is dropped from an excessive height and/or is brittle, it may be necessary to construct the wall 130 of an impact-absorbing material such as rubber, plastic, or nylon. Furthermore, the wall 130 may be solid, may include a small number of perforations, or may be substantially perforated. It may be desirable to construct the wall 130 of a perforated material to reduce the overall weight of the apparatus 100, for example, or to increase the visibility of the movement of the vial 10 as part of a quality control program.

The first opening 140 must be large enough to catch the vial 10 as it falls through a vertical drop path. The size of the first opening 140 may depend on the type of vial 10 used, and the height and location from which the vial 10 is dropped. It may be necessary to use a larger first opening 140, for example, if the drop point of the vial 10 is imprecise or varies, if the vial 10 is large, if the vial 10 tends to drift away from a drop path while falling, or if the vial 10 is dropped from varying and/or excessive heights. The receptacle 120 may need to catch articles that are dropped from multiple drop points, in which case the first opening 140 would need to be sufficiently large to include the drop path corresponding to each drop point. Alternatively, the first opening 140 may be significantly smaller, such as approximately the diameter of the vial 10, if the drop path is short or negligible. The first opening 140 may be of fixed size, as described and illustrated, or may be adjustable to accommodate articles of varying sizes and widths as well as various types of processes.

The second opening 150 is adapted to allow the vial 10 to leave the receptacle 120. The second opening 150 is large enough to give passage to the flange 50 yet sufficiently restrictive to guide the descent of the vial 10 toward the slide 160. The size of the second opening 150 may be adjustable to accommodate vials 10 or other articles of varying shapes and sizes. The second opening 150 preferably opens downward, but may open at an angle or toward a side.

The slide 160 is adapted to catch the vial 10 after it leaves the receptacle 120, and guide the descent of the vial 10 toward the platform 190. The slide 160 preferably attaches to the second segment 134 of the wall 130 and/or the platform 190, and extends below the second opening 150. The slide 160 is preferably substantially parallel with the second segment 134 of the wall 130 to eliminate any ridges that may snag the flange 50 of the vial 10 as the vial 10 slides down the wall 130. The slide 160 may be integral with the wall 130 or separate therefrom. It may be desirable for the slide 160 to be integral with the wall 130, for example, to facilitate manufacturing the slide 160 or to avoid discontinuities between the receptacle 120 and the slide 160 that may snag the flange 50 of the vial 10 and disrupt the movement of the vial 10. The slide 160 may be substantially straight or may be curved, and may deliver the vial 10 to the platform 190 in an upright position or in an inclined or horizontal position. The inner surface 166 is preferably smooth in order to allow the vial 10 to slide unimpeded. Alternatively, the surface 166 may be coarse to slow the dissent of the vial 10.

The slide 160 may be adjustable and/or removable. The slide 160 may be made adjustable, for example, by pivotally attaching the top end 162 to the second segment 134 of the wall 130. An inclination of the slide 160 could then be adjusted by pivoting the bottom end 164 of slide 160. The slide 160 may be made removable, for example, by removably attaching the top end 162 to the second segment 134 of the wall 130. It may be desirable to use a removable slide, for example, to provide access to the receptacle 120 or other element of the apparatus 100 for maintenance and upkeep, or to enable a user to quickly and easily replace the slide 160. Furthermore, the bottom end 164 of the slide may be pivotally or removably attached to the platform 190.

The flap 170 moderates the descent of the vial 10 down the slide 160. The flap 170 preferably includes a hinge 172, a secured end 174, and a pivot end 176. The hinge 172 pivotally secures the secured end 174 of the flap 170 to the first segment 132 of the wall 130. The hinge 172 is preferably secured to the wall 130 in such a manner that the secured end 174 is near the second opening 150 and the pivot end 176 of the flap 170 is free to pivot toward and away from the slide 160. The hinge 172 may be bolted or welded to the wall 130, or may be integral with the wall 130. When secured to the wall 130, the flap 170 partially impedes the path of the vial 10 as it moves down the slide 160.

The secured end 174 of the flap 170 is connected to the hinge 172, allowing the pivot end 176 to pivot about the secured end 174. The pivot end 176 is sufficiently heavy to allow the flap 170 to moderate the descent of the vial 10 along the slide 160, as discussed below. The pivot end 176 may be weighted by, for example, broadening it as illustrated in FIG. 3, by partially or completely constructing the flap 170 of a dense material, or both. The flap 170 is preferably made of a material sufficiently durable to withstand repeated contact with the vial 10 without substantial wear, yet soft enough to at least partially absorb an impact with the vial 10 to minimize bouncing and to avoid damaging the vial 10.

The flap 170 is adapted to moderate the descent of the vial 10 down the slide 160 by slowing the vial 10 in its descent and holding it against the slide 160. This may be accomplished by positioning the flap 170 to partially impede the descent of the vial 10 along the slide 160, as described above. As the vial 10 descends along the slide 160, it comes in contact with the pivot end 176 of the flap 170. The pivot end 176 of the flap 170 pivots away from the slide 160 as the vial 10 exerts pressure on it, thus allowing the vial 10 to pass the flap 170. As the vial 10 passes, the flap 170 rests on the vial 10, thus slowing the vial 10 and exerting pressure on the vial 10 in the direction of the slide 160. The flap 170 is preferably sufficiently heavy to minimize bouncing when struck by the vial 10, and sufficiently light to pivot away from the vial 10 and allow the vial 10 to pass.

It will be appreciated that the flap 170 not only accommodates irregularities in the shape of the vial 10, but also may accommodate vials 10 of varying sizes. The position, weight, and/or length of the flap 170 may be adjustable to further accommodate vials 10 and other articles of varying weights, sizes and shapes. Furthermore, the flap 170 may be removably attached to the wall 130, thus facilitating use of the apparatus 100 in processes that do not require use of the flap 170.

It will also be appreciated that there are various methods of moderating the descent of the vial 10 along the slide 160. For example, the flap 170 may be attached to the wall 130 via a spring and biased against the vial 10 as it moves down the slide 160. Such a spring may include, for example, a substantially rigid member that is attached to or integral with the flap 170 and the wall 130. Such a rigid member may secure the flap 170 below the second opening 150 and in the path of the vial 10 as it moves along the slide 160, and may flex to allow the flap 170 to move sufficiently to allow the vial 10 to pass while holding the vial 10 against the slide 160.

The side wall 180 prevents the vial 10 from deviating laterally from a preferred path of descent along the slide 160. The side wall 180 may be adapted to attach to the third segment 136 and/or the fourth segment 138 of the wall 130 near the second opening 150, and preferably substantially encloses a space between the flap 170 and the slide 160. The side wall 180 may be integral with the wall 130, may be pivotally attached thereto, or may be removably attached thereto. It may be desirable to removably or pivotally attach the side wall 180 to the wall 130, for example, in situations where a user may need access to the receptacle 120 to perform maintenance.

The platform 190 is adapted to attach to the bottom end 164 of the slide 160, to catch the vial 10 as it moves down the slide 160, and to retain the vial 10. The platform 190 may retain the vial 10, for example, until an external gripping mechanism secures the vial 10. The platform 190 may be removably attached to the slide 160 to facilitate use of the apparatus 100 in various processes. It may be desirable, for example, to remove the platform 190 to allow the vial 10 to descend from the slide 160 directly onto a conveyor belt.

It will be appreciated that the elements of the apparatus 100 described above may be made removable to facilitate, for example, their replacement or repair and to allow a user to quickly and easily modify the apparatus 100 to accommodate various types of articles and processes. For example, a removable slide 160 may allow a user to choose and install a slide 160 that best meets the needs of an article or process. The user may be able to choose, for example, a slide 160 that has a smooth inner surface 166 or a coarse inner surface 166; that is curved or straight, that is short or long. The inner surface 166 of the slide 160 may be smooth while the outer surface 168 of the slide 160 is coarse, allowing a user to alternate surfaces by inverting the slide 160. It may also be desirable to remove the slide 160 when the apparatus 100 is used in processes that do not require the slide 160, such as processes in which articles without flanges are used.

FIGS. 5–10 illustrate a preferred implementation of the apparatus 100. In use, the vial 10 is dropped into the receptacle 120 as part of an automated manufacturing process, automating dispensing process, or other automated process.

Figure 5:
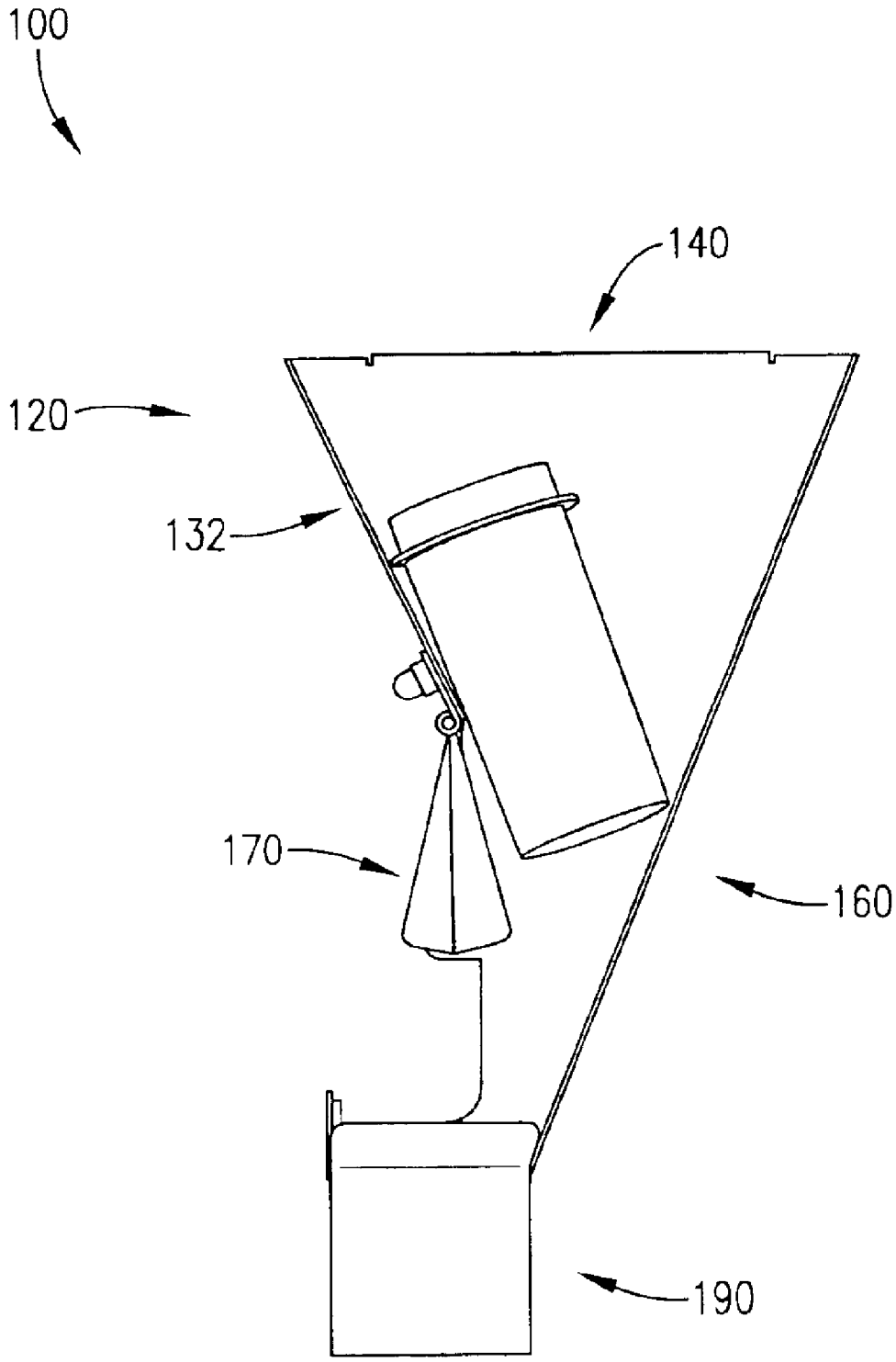
FIGS. 5–10 illustrate a process of dispensing the vial of FIG. 2 using the apparatus of FIG. 1.
Figure 6:
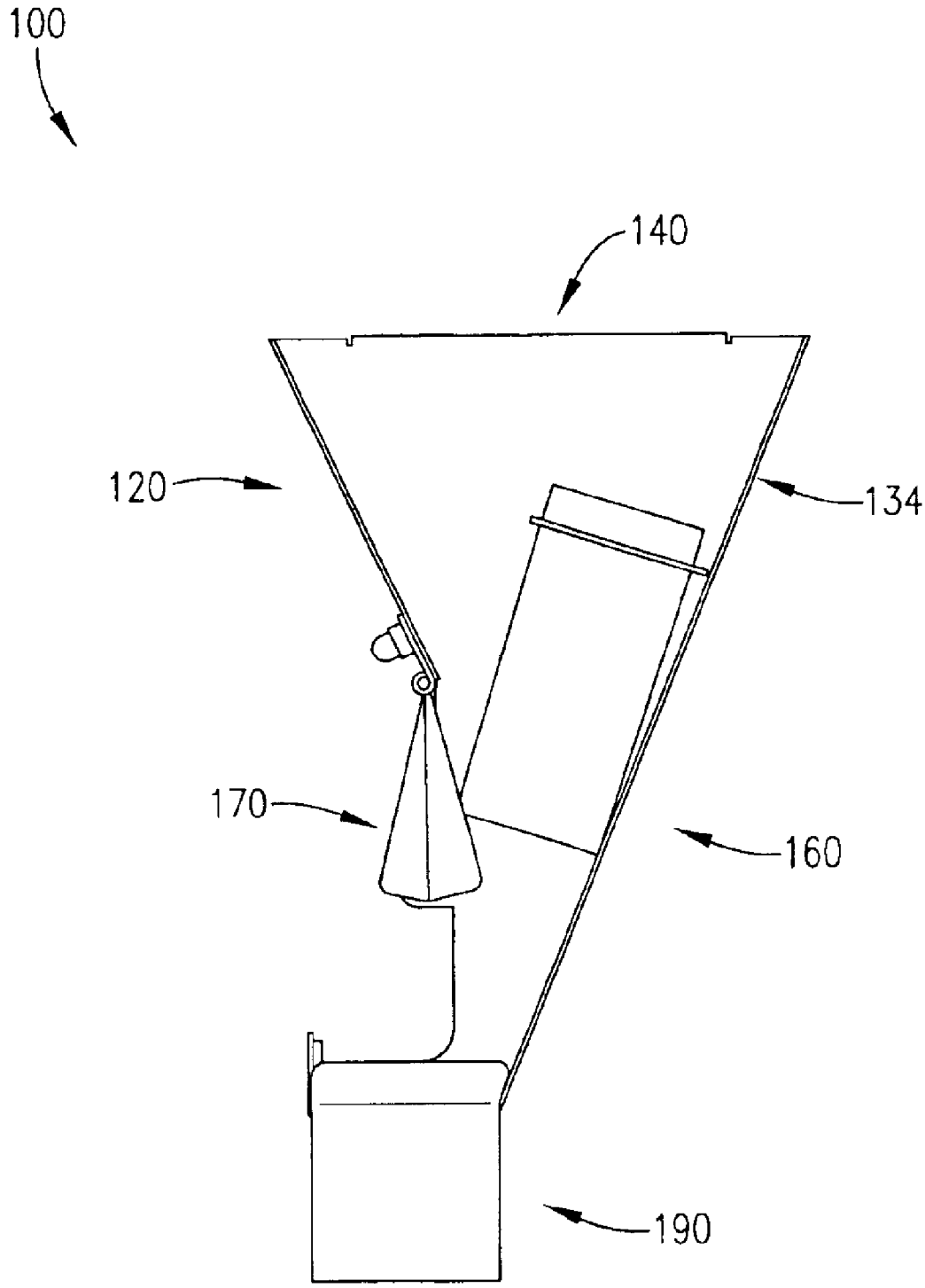

Upon entering the receptacle 120 through the first opening 140, the vial 10 contacts the peripheral wall 130, which guides the vial 10 toward the second opening 150. As the vial 10 descends toward the second opening 150, it may initially slide down the first segment 132 of the wall 130, as illustrated in FIG. 5, or may slide down the second segment 134 of the wall 130, as illustrated in FIG. 6. If the vial 10 slides down the second segment 134 of the wall 130 it leaves the receptacle 120 via the second opening 150, which is large enough to allow the flange 50 to pass without snagging the wall 130.

Figure 7:
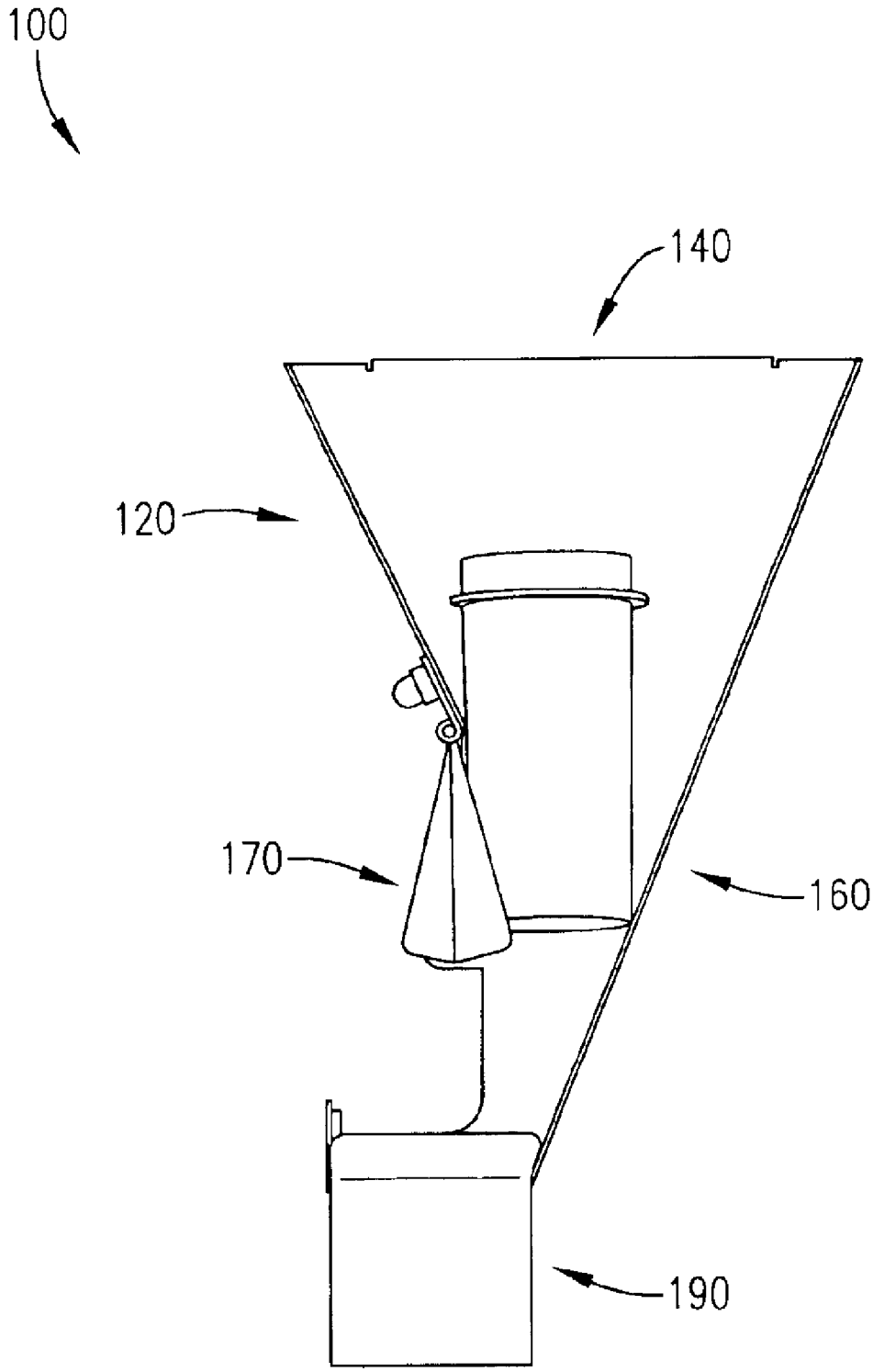

If the vial 10 slides down the first segment 134 of the wall 130, the flange 50 may tend to snag the first segment 132 of the wall 130 near the second opening 150 where there is a bend in the vial's 10 path of descent. The present invention, therefore, prevents snagging when the vial 10 slides down the first segment 132 of the wall 130 by forcing the vial 10 to rotate in its descent so that the flange 50 falls away from the first segment 132 of the wall 130. By way of illustration, if the vial 10 initially slides down the first segment 132 of the wall 130, the base 30 of the vial 10 passes through the second opening 150, contacts the slide 160, and begins to slide along the slide 160, as illustrated in FIG. 7. As the base 30 of the vial 10 moves down the slide 160, the mouth 20 of the vial 10 begins to tilt away from the first segment 132 of the wall 130 and toward the second segment 134. As the mouth 20 of the vial 10 tilts away from the first segment 132, the center of gravity of the vial 10 shifts and causes the vial 10 to fall toward the second segment 134. The vial 10 continues sliding down the second segment 134. Thus, as the vial 10 passes through the second opening 150 it moves down the slide 160 in a position parallel to the slide 160, preventing the flange 50 from snagging the wall 130 or the hinge 172 of the flap 170.

Figure 8:
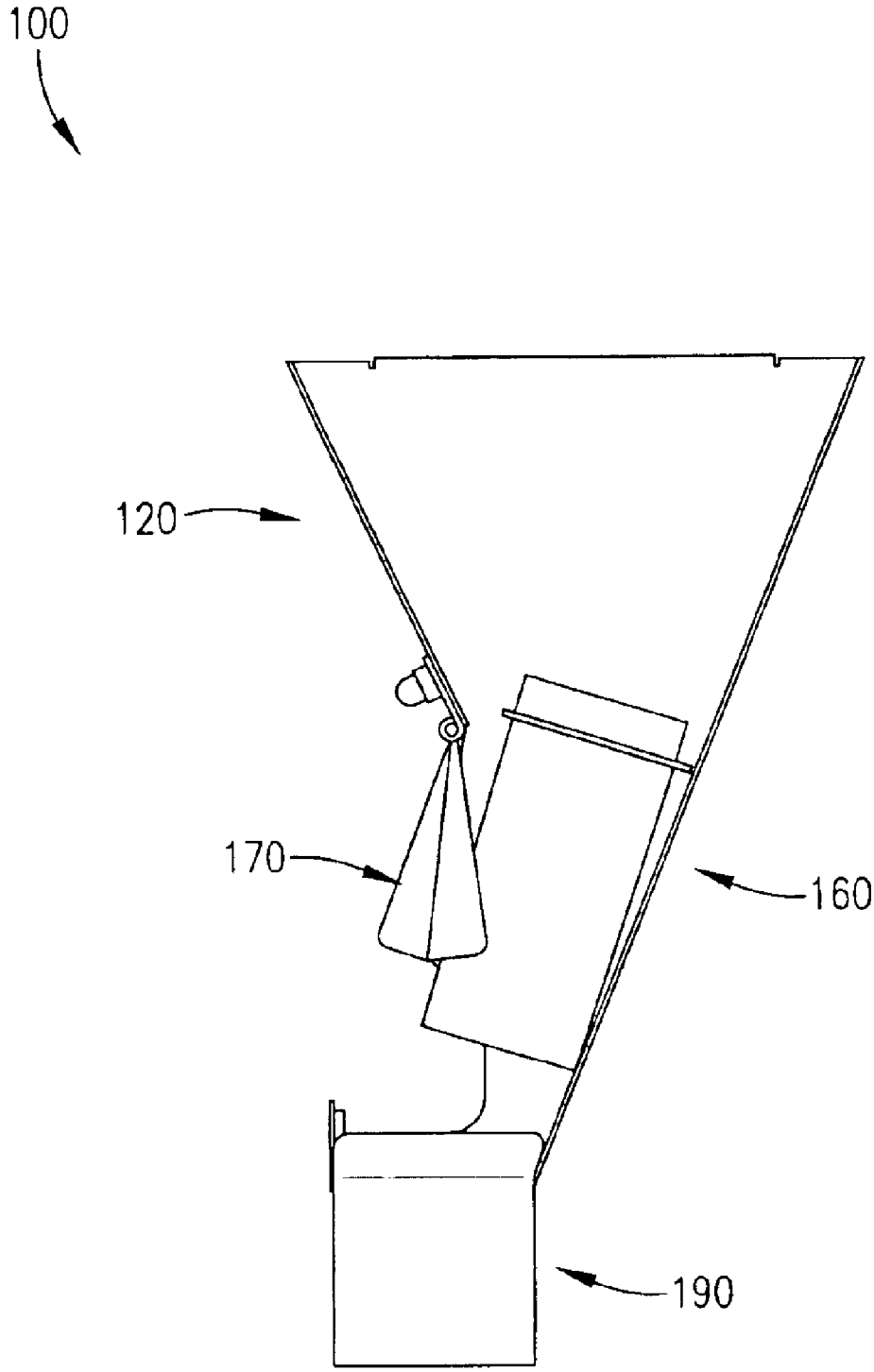
Figure 9:
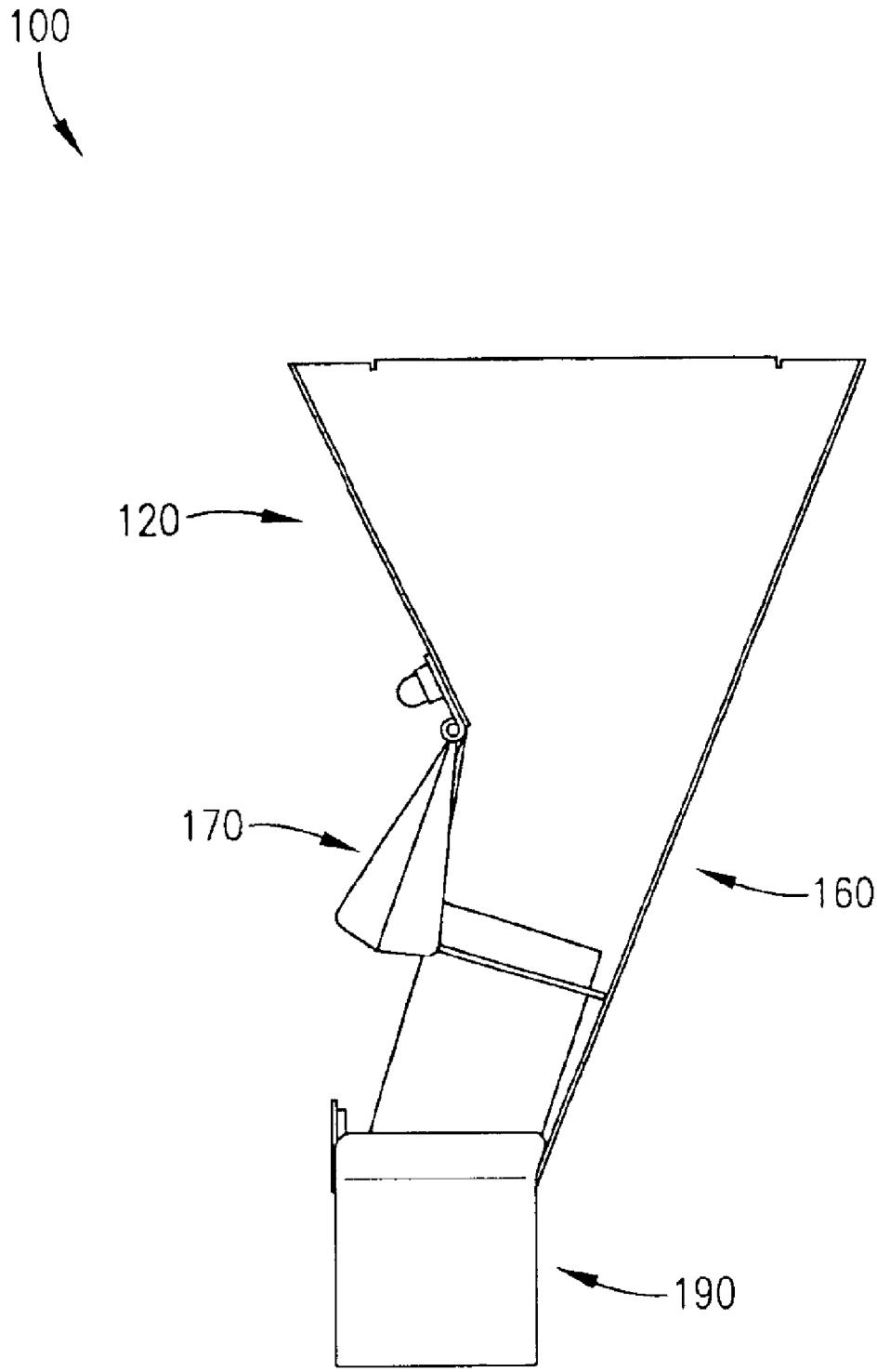
Figure 10:
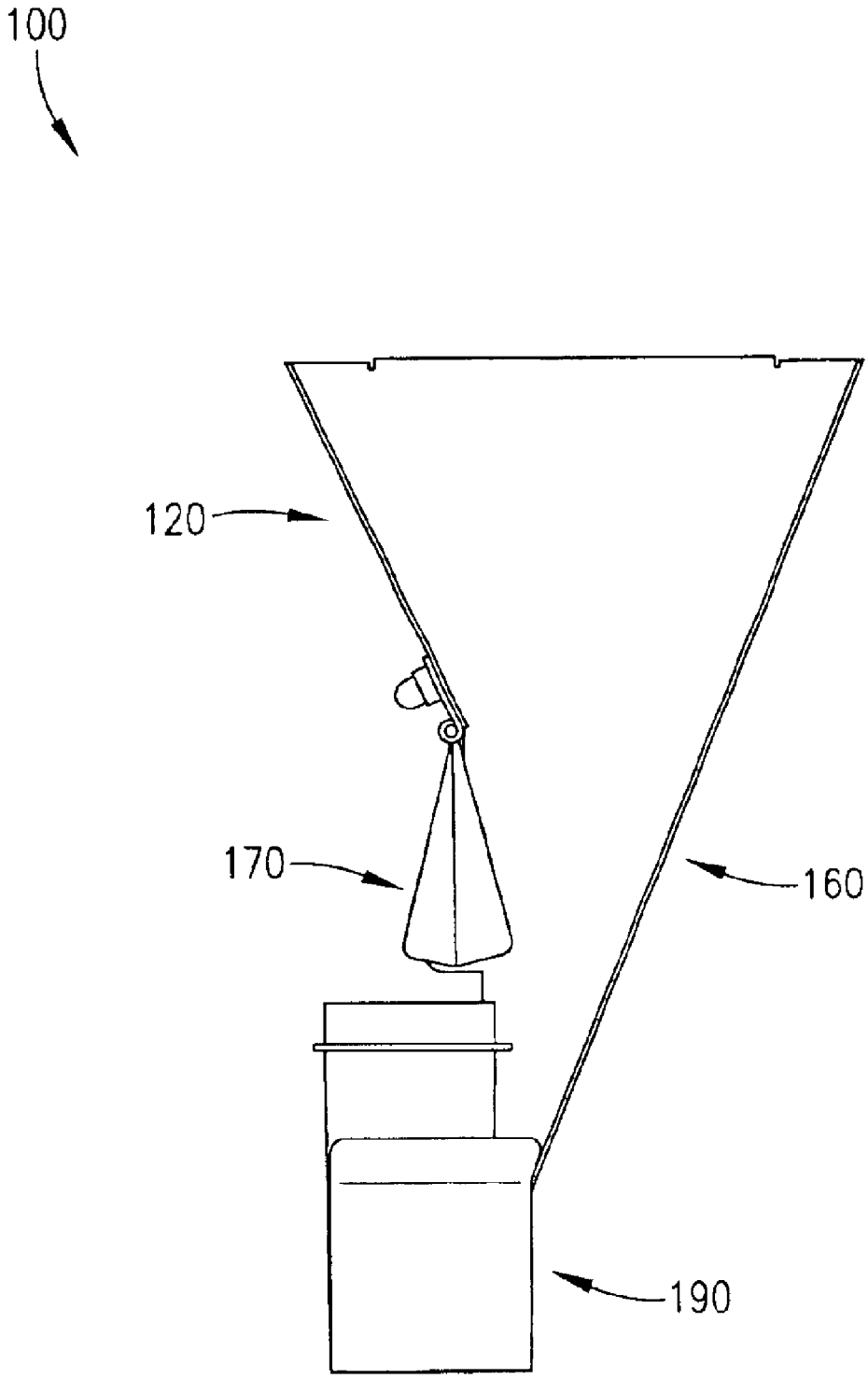

As the vial 10 moves down the slide 160, the base 30 of the vial 10 encounters the flap 170 as illustrated in FIG. 8. The pivot end 176 of the flap 170 pivots away from the vial 10 in response to pressure exerted on the flap 170 from the vial 10, allowing the vial 10 to pass the flap 170 as the vial 10 moves down the slide 160. The flap 170 also exerts pressure on the vial 10 as the flap 170 rests against the vial 10 during the vial's descent down the slide 160. The pressure exerted by the flap 170 on the vial 10 may slow the descent of the vial 10, preventing bouncing or other erratic movements of the vial 10 which may disrupt the flow of a process. The pressure exerted by the flap 170 on the vial 10 also holds the vial 10 against the slide 160 so that the vial 10 moves along a path substantially parallel to the slide 160, which may be necessary to properly place the vial 10 on the platform 190.

As the base 30 of the vial 10 approaches the platform 190, the flange 50 encounters the flap 170. The flange 50 of the vial 10 requires a wider passage than the body 40 and therefore exerts more pressure on the vial 10. In response to the pressure exerted by the flange 50 of the vial 10, the flap 170 pivots further away from the vial 10, thus creating a wider passage and allowing the mouth 20 of the vial 10 to pass. In light of the foregoing discussion, it is critical that the inner surface 178 of the flap 170 not have burrs or other irregularities that may snag the flange 50 of the vial 10 as the vial 10 moves past the flap 170.

The side wall 180 prevents the vial 10 from deviating laterally from a preferred path of descent along the slide 160. The side wall 180 may be necessary, for example, if the vial 10 tends to deviate from the path sufficiently to prevent the vial 10 from properly engaging the platform 190.

The vial 10 continues to move along the slide 160 until the vial 10 has cleared the flap 170 and engages the platform 190. The platform 190 catches the vial 10 and secures it until, for example, a gripping mechanism removes the vial 10 from the platform 190. If the apparatus 100 is positioned above a conveyor belt, a user may wish to remove the platform 190 and allow the vial 10 to descend to the belt to be carried away.

Although the invention has been described with reference to the preferred embodiments illustrated in the attached drawings, it is noted that equivalents may be employed and substitutions made herein without departing from the scope of the invention as recited in the claims. It will be appreciated, for example, that receptacle 120 may be substantially round instead of rectangular in shape.

Having thus described the preferred embodiment of the invention, what is claimed as new and desired to be protected by Letters Patent includes the following:

1. An apparatus for dispensing vials, the apparatus comprising:

a receptacle with a first opening and a second opening, wherein the first opening is adapted to receive the vial and the second opening is adapted to allow the vial to leave the receptacle;

a slide extending below the second opening and adapted to allow the vial to slide downwardly away from the receptacle; and a flap with a first end thereof pivotally attached to the receptacle near the second opening, wherein the flap includes a weight secured to a second end thereof and the flap extends beyond the second opening and is adapted to contact the vial as the vial leaves the second opening and exert pressure on the vial as the vial moves down the slide.

2. An apparatus for dispensing vials, the apparatus comprising:

a receptacle with a first opening and a second opening, wherein the first opening is adapted to receive the vial and the second opening is adapted to allow the vial to leave the receptacle;

a slide extending below the second opening and adapted to allow the vial to slide downwardly away from the receptacle;

a flap with a first end thereof pivotally attached to the receptacle near the second opening, wherein the flap extends beyond the second opening and is adapted to contact the vial as the vial leaves the second opening and exert pressure on the vial as the vial moves down the slide; and a side wall attached to the receptacle near the narrow opening adapted to maintain the vial on the slide as the vial moves down the slide, wherein the side wall extends between the slide and the flap.

3. An apparatus for dispensing vials, the apparatus comprising:

a receptacle with a broad opening and a narrow opening, wherein the broad opening is adapted to receive the vial and the narrow opening is adapted to allow the vial to leave the receptacle;

a slide attached to a portion of a wall of the receptacle near the narrow opening, extending below the narrow opening parallel to the wall, and adapted to allow the vial to slide downwardly away from the receptacle;

a flap with an end thereof pivotally attached to the receptacle near the narrow opening, wherein the flap extends beyond the narrow opening and is adapted to contact the vial as the vial leaves the narrow opening, exert pressure on the vial as the vial moves down the slide, and pivot away from the vial to allow the vial to move down the slide; and a side wall attached to the wall near the narrow opening, extending below the narrow opening between the slide and the flap, adapted to maintain the vial on the slide as the vial moves down the slide.

4. The apparatus as set forth in claim 3, further comprising a platform attached to the slide and adapted to receive and support the vial after the vial has moved down the slide.

5. An apparatus for dispensing vials, the apparatus comprising:

a receptacle with a narrowing peripheral wall, which forms a broad opening facing upward adapted to receive the vial, and a narrow opening facing downward adapted to allow the vial to leave the receptacle;

a slide attached to the wall near the narrow opening and extending below the narrow opening parallel to a portion of the wall near an end of the slide attached thereto, adapted to support the vial as it leaves the receptacle, and allow the vial to slide downwardly away from the receptacle along the slide;

a weighted flap with an end thereof pivotally attached to the wall near the narrow opening opposite the slide so that the flap extends beyond the narrow opening and partially obstructs a path of the vial as the vial moves down the slide, the flap adapted to contact the vial and force the vial into a position parallel to the slide as the vial leaves the narrow opening and moves down the slide, exert pressure on the vial to hold the vial against the slide and slow the vial's movement, and pivot away from the vial in response to pressure from the vial to allow the vial to leave the receptacle and move down the slide;

a side wall attached to the wall near the narrow opening, extending below the narrow opening between the slide and the flap, adapted to maintain the vial on the slide as the vial moves down the slide; and a platform attached to the slide and adapted to receive and support the vial after the vial has moved down the slide.

* * * * *